United States Patent [19]

Murray et al.

[11] Patent Number: 4,967,636

[45] Date of Patent: Nov. 6, 1990

[54] FUEL-AIR LINE-CHARGE ORDNANCE NEUTRALIZER

[75] Inventors: Stephen B. Murray, Medicine Hat; David S. Weiss, Cowansville; Ingar O. Moen, Medicine Hat, all of Canada; Stephen A. Ward, Fullerton, Calif.

[73] Assignee: Her Majesty the Queen in right of Canada, as represented by the Minister of National Defence, Ottawa, Canada

[21] Appl. No.: 389,747

[22] Filed: Aug. 4, 1989

[30] Foreign Application Priority Data

Sep. 23, 1988 [CA] Canada ..... 578294

[51] Int. Cl.[5] ..... F41F 1/00; F41H 11/12

[52] U.S. Cl. ..... 89/1.13; 102/370

[58] Field of Search ..... 89/1.13; 102/367, 368, 102/369, 370

[56] References Cited

U.S. PATENT DOCUMENTS

| | | | |
|---|---|---|---|
| 2,455,354 | 12/1948 | Bisch | 89/1.13 |
| 3,183,835 | 5/1965 | Bisch | 89/1.13 |
| 3,242,862 | 3/1966 | Stegbeck et al. | 89/1.13 |
| 3,596,603 | 8/1971 | Gryting et al. | 102/367 |
| 3,638,569 | 2/1972 | Thomanek | 89/1.13 |
| 3,724,319 | 4/1973 | Zabelka et al. | 89/1.13 |
| 4,671,162 | 6/1987 | Adlam et al. | 89/1.13 |
| 4,776,255 | 10/1988 | Smith | 89/1.13 |
| 4,823,672 | 4/1989 | Eidelman | 89/1.13 |

FOREIGN PATENT DOCUMENTS

| | | | |
|---|---|---|---|
| 2226065 | 11/1974 | France | 89/1.13 |
| 2199289 | 7/1988 | United Kingdom | 89/1.13 |

*Primary Examiner*—David H. Brown

*Attorney, Agent, or Firm*—William R. Hinds

[57] ABSTRACT

The invention provides a system for breaching a lane in a minefield containing pressure sensitive mines. A mobile carrier mounts fuel, nitrogen and water tanks, a hose magazine and a launch rail. A flexible hose is folded into the magazine for rapid deployment therefrom and carries a detonating cord therein. A tow vehicle, such as a rocket, is connected to the free end of the hose so that when it is launched it will pull the hose across the minefield. Thereafter, pressurized nitrogen is used to drive liquid fuel into the hose, followed by a slug of water between the fuel-containing section and the carrier. Detonation of the cord creates a fuel droplets-in-air-cloud above the hose, which cloud is subsequently detonated to create a pressure wave which, in turn, detonates or neutralizes the mines along the desired lane, allowing vehicles and personnel to travel therealong. Means are provided to space the detonating cord from the inner wall of the hose so as to prevent the formation of hot spots as the cord detonates, which hot spots could result in premature local deflagration of the fuel droplet-air cloud.

29 Claims, 7 Drawing Sheets

FUEL-AIR LINE-CHARGE ORDNANCE NEUTRALIZER

The present invention relates to means for establishing a safe path for vehicles and personnel through a minefield.

BACKGROUND OF THE INVENTION

During combat, the situation might arise where it is necessary to breach a "safe" lane through either friendly or enemy minefields in order to facilitate a retreat or an assault on enemy positions. By safe, it is meant that any mines in the lane must either be removed, rendered nonfunctional, or neutralized through induced triggering, thus allowing passage of troops and vehicles through the minefield without incident.

A survey of current minefield detection and breaching methods indicates that most existing mine-clearing techniques are based on either mechanical devices such as ploughs, rollers and flails, or on explosive devices such as the high-explosive (HE) line charge and the fuel-air explosive (FAE) canister array.

The high-explosive line charge is exemplified by the U.K. "Giant Viper" system which consists of a 183 m long hose filled with PE6/A1 high explosive. Weighing almost 1500 kg, the Giant Viper is carried aboard a trailer and towed to the minefield by an armoured vehicle. It is projected across the minefield from a standoff of 100 m by a flight vehicle powered by eight rocket motors. Three arresting parachutes straighten, stabilize and decelerate the hose as it falls across the minefield. A delayed fuse, activated by the parachutes, then detonates the explosive-filled hose producing a blast wave which triggers single-impulse pressure sensitive mines within a distance of 3.5 m from the charge.

The FAE canister system is the basis of the U.S. Surface Launched Unit Fuel-Air Explosive (SLUFAE). The SLUFAE system consists of 30 rocket-propelled canisters mounted on a tracked cargo vehicle. Each canister contains 38.5 kg of liquid propylene oxide fuel. These are sequentially launched from a 700 m standoff and follow parachute retarded trajectories to land along a line spanning the minefield. Upon impact, the fuel in each canister is dispersed to form an explosive fuel droplet-air cloud which is subsequently detonated by a small explosive charge. The detonation of each cloud produces a blast wave capable of activating surface-laid single-impulse pressure sensitive mines within a circular area 20 m in diameter. The SLUFAE device is also intended to neutralize buried single-impulse mines, an operation which requires substantially higher specific impulses. For mines buried 15 cm below grade, a SLUFAE canister is capable of clearing a 12 m diameter circle. In such a minefield, the 30 canisters are deployed in an overlapping linear array to clear a path 160 m long and 8 m wide.

Both minefield breaching systems described above are inadequate in terms of operational reliability, effectiveness and cost. Launching the high-explosive line charge across a minefield is a difficult and hazardous operation with a relatively high occurrence of misfires. Furthermore, the detonation of the high-explosive charge produces a "skip zone" of decreased pressure and impulse, parallel to and about 1 m off the charge axis, where mines might not be triggered.

From a fundamental point of view, the use of high explosives is not the most attractive option for breaching purposes. This is true for two reasons. First, a significant fraction of the high-explosive material is oxygen, which must be launched over the minefield along with the fuel component, despite the abundance of readily available oxygen along the intended breach lane. This results in a larger payload having to be deployed than would be the case if ambient oxygen was consumed in the reaction. Second, high explosives produce a blast field with pressures and impulses which far exceed those required for breaching in the near field, but which fall off rapidly with increasing distance from the charge and quickly becomes unsatisfactory for breaching purposes. In other words, the distribution of available energy or "energy density" is far from optimum.

An attractive altérnative to high explosives, which avoids these fundamental shortcomings, is fuel-air explosives. With this type of explosive, atmospheric oxygen is consumed during the detonation reaction. As well, the fuel is distributed over a large area, resulting in a charge of lower energy density, but making more effective use of the fuel. Although the U.S. SLUFAE system enjoys these advantages over the Giant Viper, it too suffers drawbacks, but of a different nature. For example, the system requires high deployment accuracy in order to ensure that the canisters land properly spaced along a line across the minefield. With the canisters being parachute retarded, this tends to be a difficult feat, particularly in the presence of any cross winds. As a result, the design cloud overlap must be substantial in order to eliminate skip zones where mines would not be triggered. This creates yet another problem; namely, that the hot combustion products resulting from the detonation of one cloud tend to prematurely ignite the fuel droplet-air cloud produced by the neighbouring canister. The mere fact that SLUFAE attempts to approximate a lane by a series of overlapping circular clouds also means that the fuel is not being used efficiently.

SUMMARY OF THE INVENTION

The present invention overcomes the problems of the prior art described above while utilizing the advantageous features of the high-explosive line charge system and those of the fuel-air explosive system. The system of this invention may be characterized as a fuel-air explosive line charge system. It consists of a hose which is filled with a liquid hydrocarbon fuel and which contains a cord of detonating material. Many commercially available types of fire hose have been tested and found to be suitable for this application. In fact, the most common sizes of fire hose (75-mm to 100-mm diameter) are ideal for achieving the desired breach width.

Several different hydrocarbon fuels have also been found appropriate, including propylene oxide, hexylnitrate and ethylhexylnitrate. When the detonating cord contained inside the hose is initiated, the energy produced by the detonation ruptures the hose and propels the fuel radially outward, forming a fuel droplet-air cloud of approximately hemi-cylindrical geometry. The detonating cord is commercially available from a variety of suppliers. Extensive experimentation has shown that the pressure-impulse characteristics of the cloud are optimal when the fuel is distributed in such a manner that the cloud is globally stoichiometric in composition. Tests have shown that this occurs if the mass ratio of liquid fuel to detonating cord is approximately 50. Once the droplet-air cloud has been formed, a secondary high-explosive charge, situated within the anticipated FAE cloud, is exploded to commence a detonation wave that propagates from one end of the cloud to the other. Propagation takes place at a velocity of approximately two kilometers per second. The pressures generated within the cloud (approximately 15 atmospheres) are sufficient to defeat most single-impulse pressure sensitive mines. The delay between detonation of the burster charge and secondary charge is on the order of 0.1 seconds, so that the phenomenon is not adversely affected by ambient winds.

Based on the charge configuration discussed above a line-charge deployment system includes a rocket-powered tow vehicle to distribute an empty (i.e., no liquid fuel contained therein) line-charge hose over a mined area. Subsequently, the hose is rapidly filled with a suitable liquid fuel. Following this fuel filling phase, a slug of water is injected into the hose in order to isolate the carrier vehicle from any combustible/explosive material. After the slug has been created, the detonating cord is initiated to form a fuel droplet-air cloud. A series of secondary charges, distributed along the length of the line charge, are then detonated to establish propagation in the droplet-air cloud.

In order to avoid hot spots that might occur where the detonating cord contacts the hose, which hot spots could result in premature deflagration of the fuel droplet-air cloud, it is desirable from a pressure-impulse point of view (although not essential for detonation propagation) to provide the detonating cord with some means for spacing the cord from the inner wall of the hose. Such means could include disc-like or cruciform spacers positioned along the cord or sets of collapsible fingers positioned along the cord. The preferred spacing means however is a foam rubber jacket around the cord and extending the length thereof. The jacket would have to be made from a material which is insensitive to the fuel; it would need an open cell structure to permit the fuel to surround the cord; it should be of low density; and it should occupy as little space as possible when dry, expanding substantially in the presence of fuel so as to perform its desired function. It has been found for example, that neoprene works quite satisfactorily but it is expected that other rubber materials could work as well as or better than neoprene.

In summary, therefore, the present invention provides a system for breaching a safe lane through a minefield containing pressure sensitive mines comprising mobile carrier means, a length of flexible hose carrying therein and therealong a small diameter cord of explosive material, the hose being carried by the carrier means for deployment therefrom; hose deployment means carried by the carrier means and launchable therefrom, one end of the hose being connected to the deployment means with the other end of the hose being connected to the carrier means; liquid fuel storage means on the carrier means; means on the carrier means for rapidly transferring fuel from the storage means to the hose after deployment thereof; and means for detonating the cord after hose deployment to create a cloud of fuel droplets-in-air above the minefield along a line defined by the deployed hose, and for thereafter detonating the cloud to create a pressure wave which detonates or neutralizes the mines along the lane.

The invention will now be described in greater detail and with reference to the drawings.

DESCRIPTION OF THE PREFERRED EMBODIMENT

The U.K. GIANT VIPER minefield breaching system is shown in FIGS. 1A to 1D. Therein, an armoured vehicle V is shown near a minefield M to be breached. The vehicle tows a trailer T which carries a hose H. When used, a flight vehicle R, such as an 8-motor rocket, pulls the hose H across the minefield M (FIG. 1B) and then three arresting parachutes P straighten, stabilize and decelerate the hose so that it falls across the minefield as in FIG. 1D. A delayed fuse, activated by the parachutes, detonates the explosive within the hose to produce a blast wave which triggers single-impulse pressure sensitive mines within a distance of about 3½ meters from the hose. The disadvantages of this system have been discussed previously and need not be reitereated herein.

Figure 1A:
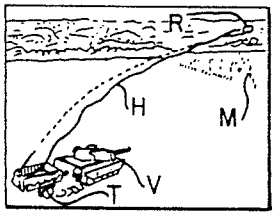
FIG. 1A PRIOR ART
FIGS. 1A to 1D show the operation of the prior art GIANT VIPER high explosive minefield breaching system.
Figure 1B:
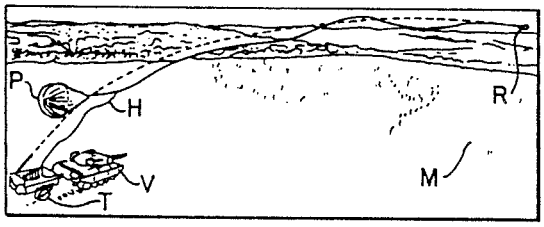
FIG. 1B PRIOR ART
Figure 1C:
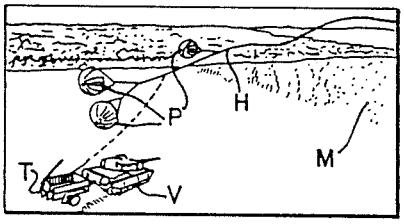
FIG. 1C PRIOR ART
Figure 1D:
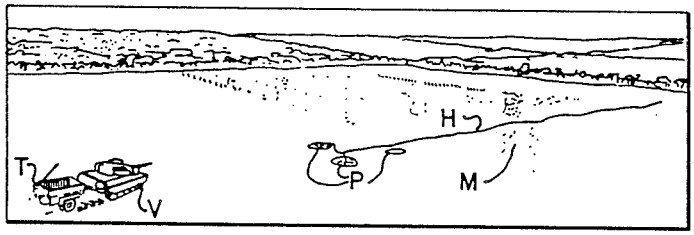
FIG. 1D PRIOR ART
Figure 2:
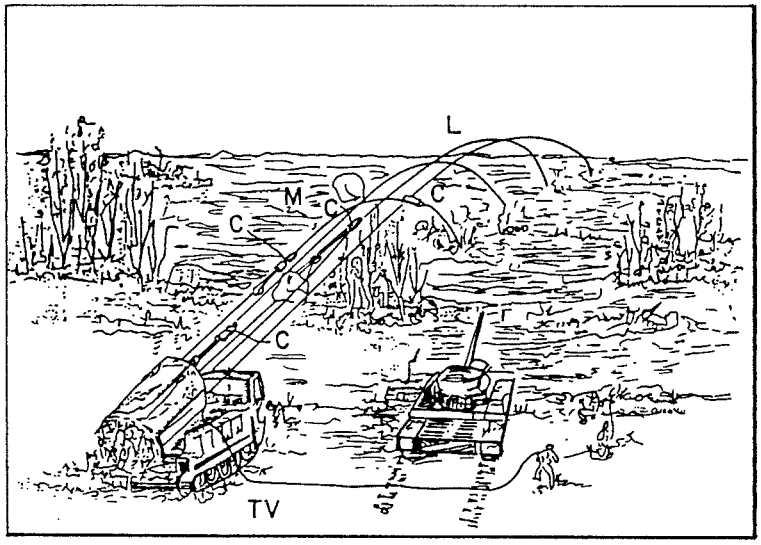
FIG. 2 PRIOR ART
FIG. 2 shows the operation of the prior art U.S. fuel-air explosive minefield breaching system.

The U.S. Surface Launched Unit Fuel-Air Explosive (SLUFAE) system is depicted in FIG. 2. A plurality, such as 30, of rocket-propelled canisters C are sequentially launched from a tracked vehicle TV and follow parachute retarded trajectories L to land along a line spanning the minefield M. Upon impact, the fuel in each canister is dispersed to form a cloud of explosive fuel droplets which is subsequently detonated by a small charge. The resulting blast wave should be capable of activating surface-laid single-impulse pressure sensitive mines along a line about 20 m wide.

The disadvantages of the SLUFAE system have been discussed previously and need not be reiterated herein.

Figure 3:
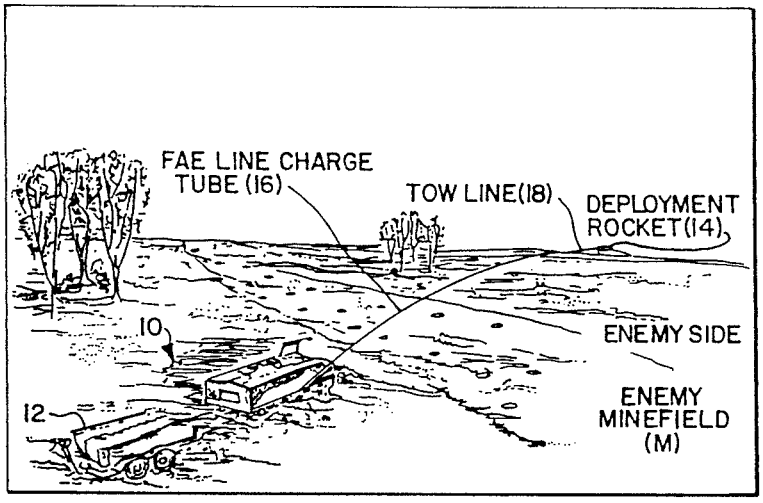
FIG. 3 shows the operation of the high-explosive fuel-air minefield breaching system of the present invention.
Figure 4:
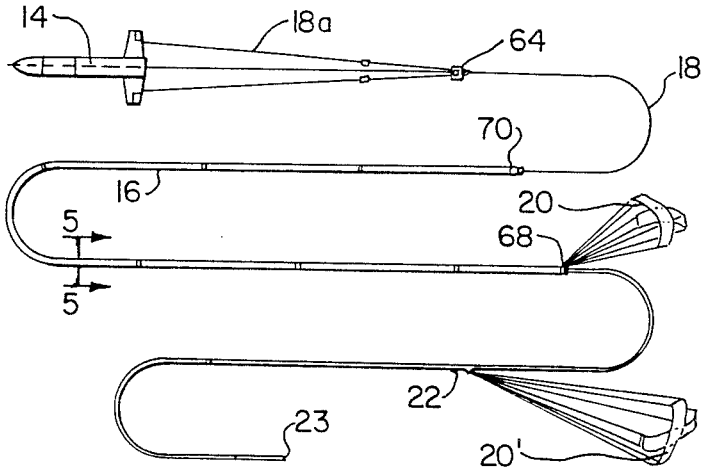
FIG. 4 shows the flight assembly of the present invention.
Figure 5:
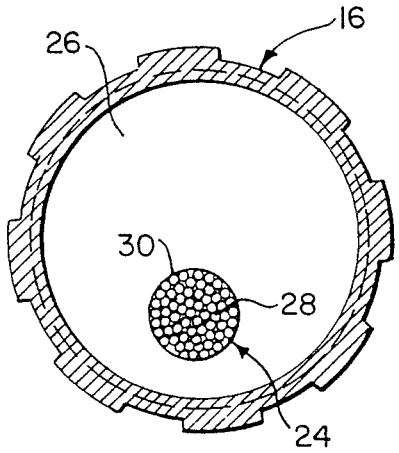
FIG. 5 shows a cross-section of the hose used in the present invention, as taken on the line 5—5 of FIG. 4.

The minefield breaching system of the present invention exhibits the advantages of the two prior art systems discussed herein without suffering from the disadvantages thereof. The system 10 is shown in an operational mode in FIGS. 3 and 4 and includes a trailer or other carrier 12 on which the components are mounted for transport and from which they are deployed as required, a rocket powered tow vehicle 14, a flexible main hose 16 connected to the tow vehicle 14 by a tow line 18, arresting drogue parachutes 20 and a flexible umbilical tube 22 anchored at one end 23 to the carrier vehicle 12 and at the other end to the trailing end of the hose 16. Internally, the hose 16 carries a high explosive detonating cord 24 (FIG. 5) which takes up only a small portion of the internal space 26 of the hose. As seen in FIG. 5 the detonating cord 24 preferably includes a plurality of individual strands 28 contained in a polyethylene jacket 30 to resist attack by fuel contained within the hose 16.

Figure 6:
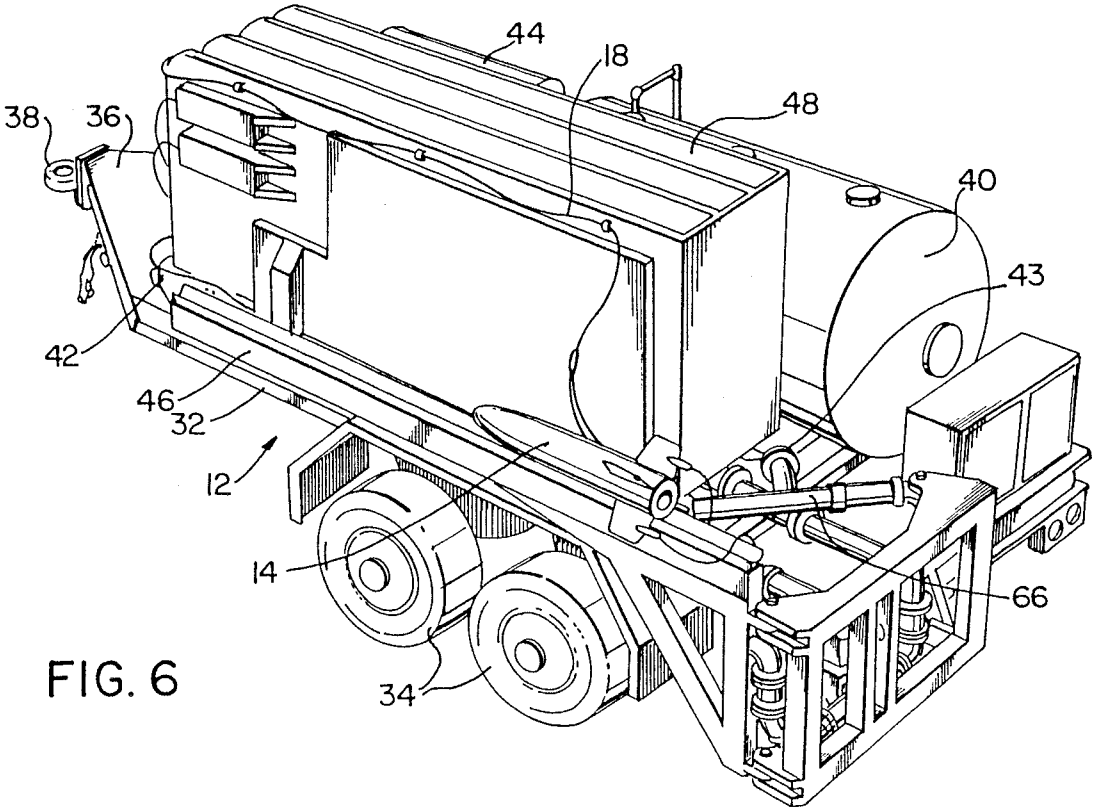
FIG. 6 shows a typical transport vehicle which could be used to transport the system of the present invention to a minefield to be breached.

The trailer or carrier 12 carries all components of the system of this invention and is thus completely self-contained. With reference to FIG. 6 the carrier 12 is shown as including a frame 32 mounting road wheels 34 thereon and having a tongue 36 and hitch point 38 for connection to a towing vehicle such as a tank or armoured personnel carrier. The carrier 12 also mounts a fuel tank 40 a first fuel valve 43, high pressure nitrogen tanks 42, a second nitrogen valve (not shown) a water tank 44, a launch rail 46 along which the launch vehicle 14 will travel during launch, and a storage magazine 48 for storing the line-charge hose 16 and the umbilical hose 22.

Figure 7:
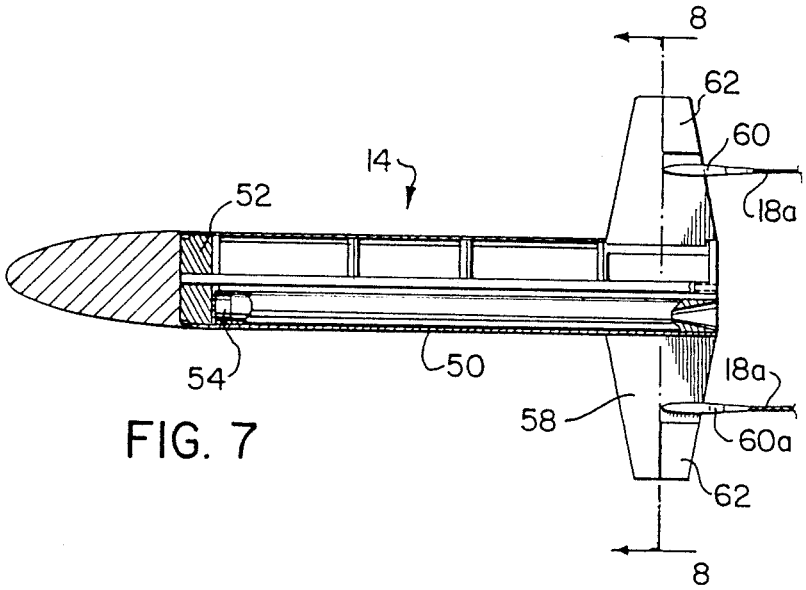
FIG. 7 shows a longitudinal cross-section of a deployment rocket for the present invention, taken on the line 7—7 of FIG. 8.
Figure 8:
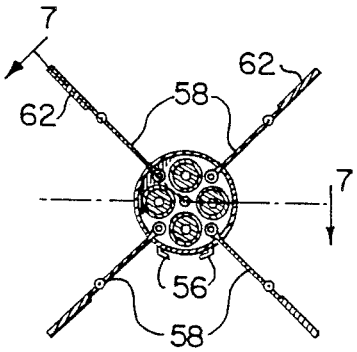
FIG. 8 shows a transverse cross-section of the deployment rocket, taken on the line 8—8 of FIG. 7.

The tow vehicle 14 is shown in some detail in FIGS. 7 and 8. The propulsive power for the tow vehicle is provided by four 70 mm CRV7 rocket motors 50. The thrust loads developed are taken at the forward bulkhead 52 (see FIG. 7). The rockets are attached to the bulkhead by four moulded plastic fittings 54. Two pairs of clamps 56 are attached to the bulkhead 52 to retain and guide the vehicle along the launch rail 46. The vehicle is stabilized in flight by four steel fins 58. Two tow cable attachment fittings 60 are mounted at the trailing edge of two opposing fins and secured with pins. The rocket motor nozzles are equipped with vanes which deflect the rocket exhaust products to produce torque and thus cause rotation of the vehicle during flight. This motion is augmented through an applied roll torque produced by fixed control surfaces 62 located at each fin tip. The purpose of the rolling motion is to cancel out drag assymetries.

The tow cable 18 transmits towing forces to the line-charge hose 16, separates the line-charge hose from potentially damaging hot rocket exhaust products and isolates the line-charge hose from the rolling motion of the tow vehicle 14. The tow cable 18 consists of two insulated tow lines 18*a*, a load equalizing bridle 60*a*, a swivel assembly 64 and the tow line proper. The insulating material covering the tow lines is ceramic. Towing forces developed during flight can reach 2000N.

The line-charge storage magazine 48, mounted on the trailer 12, is 3.65 m in length and divided into three sections. Two sections are 160 mm in width and hold 28 layers of folded 100-mm diameter hose. The third section is 108 mm in width and holds 28 layers of folded 65-mm diameter hose. The forward end and the top of the magazine 48 are open to allow rapid withdrawal of the hose 16 by the tow vehicle 14. Withdrawal of the hose 16 begins at the top of the compartment furthest away from the launch rail 46. A series of folds in the hose enables a smooth transition from the bottom hose layer in one compartment to the top hose layer in the adjacent compartment, without introducing twists in the hose. Packing of the hose begins at the umbilical end, with a sufficient length of hose left outside the magazine to permit the launch rail to swing out completely without hinderance. From both the 200 m position and the 245 m position, separate nylon ropes lead out of the magazine 48 to parachutes 20, 20′ contained in cylinders mounted on the outside of the magazine. The top layer of 100-mm diameter hose is connected to the tow line 18 which is laid into the magazine 48 in the same fashion as the hose.

The dynamics of the system are summarized as follows. At ignition of the rocket motors 50, the tow vehicle 14 is prevented from moving down the launch rail 46 by a restraining link (not shown). The link breaks when the thrust produced exceeds that of 3 motors. This means that 4 motors are functioning, and sufficient velocity will be developed at the end of the 3.65-m long launch rail to achieve stable flight. The rocket-powered tow vehicle 14 is aerodynamically conventional, but is unusual in that it has a high mass of 108 kg at ignition.

Initially, the rocket 14 accelerates rapidly, having only the light tow cable assembly 18 to draw from the magazine 48. At a slant range of 15.2 m (the length of the tow cable), the line-charge hose 16 begins to be drawn from the magazine 48, adding weight to the flight assembly. As the flight continues, the length of exposed line-charge hose increases, and its drag as well as its weight begin to decrease the flight speed.

At rocket motor burnout, (t=2.24 seconds), the high towing forces are no longer available, and the flight velocity begins to decrease under the influence of drag forces. At this point along the trajectory, the weight of the tow vehicle becomes effective. Its inertia contributes to the continuation of the flight, along with the weight of hose withdrawn to this point. As more hose is drawn from the magazine 48, drag forces increase, and the flight velocity falls off. Studies show, however, that the residual velocity at the impact point can reach values as high as 21 meters per second.

Since the mass of the flight assembly approaches 450 kg, the kinetic energy available is considerable, and the hose may be torn from its point of attachment if some type of braking is not applied to the assembly. For this reason, a first parachute 20 attached to the line-charge hose 16 by a cable is deployed at the two thirds position along the trajectory. The parachute 20 is of the cross type, notable for its rapid characteristics, and stowed in a tube attached to the outside of the magazine 48. The function of the parachute 20 is to reduce the velocity of the line-charge assembly at the point of impact. A second parachute 20′ is deployed at the three quarters position along the flight path to further reduce the impact velocity.

At the impact point, the tow vehicle motion stops. However, the line-charge assembly forward motion continues, and this velocity is reduced to zero using the launch rail 46 as a large-capacity energy absorber. The absorption of the residual energy of the line-charge assembly at impact is accomplished by swinging the launch rail 46 out to one side of the carrier 12, using a hydraulic cylinder 66. The end of the line-charge assembly is attached to the forward part of the launch rail 46. As the forward motion continues, the slack in the line-charge assembly is taken up and large forces develop at the hose attachment point due to inertia of the line-charge assembly. The launch rail tip travels forward at a distance of up to 2.6 m under the influence of these inertially developed forces, forcing oil under controlled pressure out of the hydraulic cylinder 66. Up to 37,000 Joules of energy can be dissipated using moderate (170 atm) oil pressure. The sideways extension of the launch rail 46 also positions the line-charge hose 16 so that movement of the vehicles can take place without tracks or tires treading upon the hose.

Thus, it is seen that the launch rail 46 functions in two modes. In the first mode, it provides the initial guidance in aiming the rocket-powered tow vehicle 14. In the second mode, it serves as an important element in a system to dissipate the residual energy of the flight assembly. As the tow vehicle 14 leaves the rail 46, the slack in the tow cable 18 is taken up and the swivel assembly 64 is drawn rapidly from its containing sleeve mounted on the underside of the launch rail 46. The departure of the swivel assembly 64 actuates a limit switch which, in turn, operates a solenoid valve admitting oil under pressure to the swing cylinder 66, thus moving the launch rail in azimuth.

At the end of the flight, the launch rail 46 is pulled by the line-charge assembly and swings toward its original straight ahead position. As the internal pressure in the hydraulic cylinder 66 increases under the forces applied by the inertia of the line-charge assembly, the oil is throttled through a relief valve, thus absorbing the residual kinetic energy of the moving hose and bringing it to a stop. The distributed line-charge hose is now ready to be filled with liquid fuel.

The use of parachutes for braking purposes enables the line-charge hose assembly to be assembled in discrete pieces instead of requiring very long continuous lengths of hose. Such would be the case if the hose passed through a mechanical brake. This enables standard lengths of 100-m diameter fire hose to be assembled in order to achieve the required length of breach. The design breach length is 200 meters. This is achieved by using six lengths of hose 30.5 m long plus one length of hose 18 m long. The design standoff (i.e., the distance between the edge of the minefield and the deploying vehicle) is 100 meters. Since the standoff or "umbilical" hose 22 transmits fluid but is not used for breaching purposes, it is of smaller 65-mm diameter. It is constructed from three 30.5-m lengths of hose plus an additional 9-m length of hose. An aluminum fitting 68 connects the two different diameters of hose. The aft end of the umbilical hose 22 terminates with a fitting which is attached to the forward end of the launch rail 46. The 100-m diameter hose 16 contains detonating cord 24 of 170 gram per meter weight. The 65-mm diameter hose 22 contains control wires (not shown) for the purpose of initiating the burster and secondary charges.

Once the hoses 16,22 have been deployed as described hereinabove, it is necessary to fill the hose 16 with fuel. The fast fuel filling system consists of a high-pressure nitrogen supply 42, a fuel tank 40, a water tank 44 and a network of associated pipes, valves and control equipment. The flow of fuel is initiated by applying high-pressure nitrogen, stored in a pair of steel cylinders 42 mounted on the trailer 12, to the free surface of fuel in the fuel storage tank 40. Fuel exits the tank 40 through one of two valves located on the underside and at either end of the tank. The valve from which fuel exits the tank 40 is selected by a level sensing device so that fuel flows from the lowest end of the tank. The rate of fuel flow is exceptionally high so that the 200 m length of line-charge hose 16 is filled in a relatively short time (i.e., a time on the order of 1–2 minutes). Once a pressure sensor detects that the hose 16 has been completely filled, the valve at the exit of the fuel tank 40 is automatically closed. At the same time, the high-pressure nitrogen supply 42 is redirected to the water tank 44, forcing water from the tank 44 into the supply piping to the line-charge hose 16. The amount of water injected is that necessary to fill a length of 65-mm diameter umbilical line 22 deemed appropriate to safely isolate the carrier vehicle from the explosive event. As water is injected into the umbilical line 22, an equal amount of fuel is vented from a relief valve 70 located at the downstream end of the line-charge hose. A substantially high internal pressure has been selected from the filling operation (i) to ensure that the hose 16 remains approximately circular in cross section, (ii) to help guarantee that kinks in the hose 16 are straightened out, (iii) to minimize the filling time of the charge, and (iv) to eliminate troublesome vapour bubbles from forming inside the hose 16 (these have been found to be the cause of premature cloud ignition). Both the fuel and water are routed through a filler tube (not shown) contained inside the launch rail 46. These fluids enter the line-charge hose through a fitting attached to the end of the launch rail.

Figure 9:
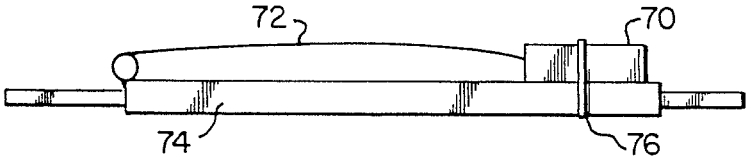
FIGS. 9 to 11 show the manner in which the secondary charge is attached to the hose and subsequently deployed for detonation.

Having filled the line-charge hose 16 with fuel, the firing sequence is started. A controller provides an electrical pulse which initiates a detonator attached to the fill end of the detonating cord 24. As the cord undergoes detonation, the fuel is propelled outward forming a fuel droplet-air cloud. The same electrical pulse is used to initiate a series of delay detonators. These are embedded in high-explosive secondary charges whose purpose is to commence detonation of the droplet-air cloud. The secondary charges are attached to the line-charge assembly at specified intervals as seen more particularly in FIGS. 9–11. Therein, it will be seen that each secondary charge 70, including for example about one kilogram of high explosive, is attached to a spring wire 72 which is held to the hose 16 by an expandible sleeve 74. As found in FIG. 9 the charge 70 is positioned against the sleeve 74 by a rupturable band 76. In this position the spring wire is coiled, in tension.

Figure 10:
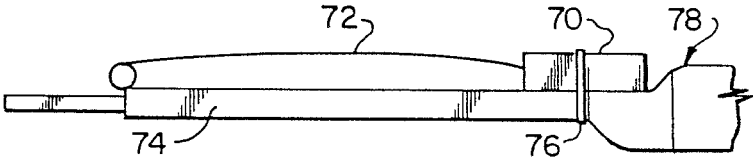

FIG. 10 shows the hose 16 inflating as the fuel is forced therealong, the hose growing in diameter as at 78. The sleeve 74 is also starting to expand at that point.

Figure 11:
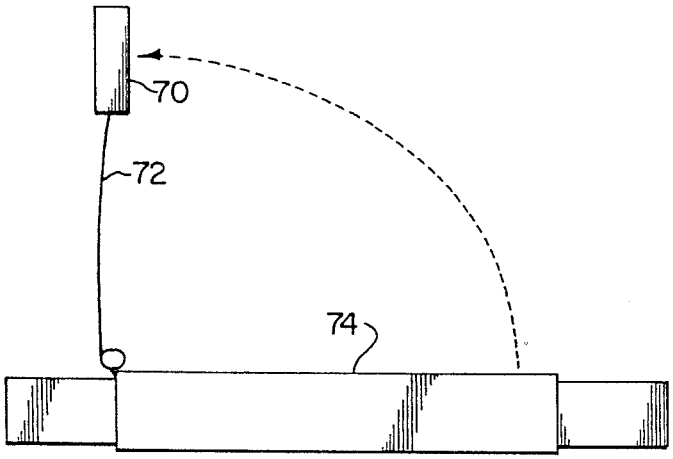

FIG. 11 shows that the force of the moving fuel is sufficient to rupture the band 76, releasing the charge 70 and allowing the spring 72 to pivot the charge to a position elevated above the hose 16. As seen in FIG. 11 the hose 16 and sleeve 74 have expanded radially during the filling step.

The detonator time delay is suitable to allow full development of the cloud. As the fully developed cloud detonates, the resulting pressure wave will detonate or neutralize mines within the minefield along a path defined by the hose 16 and sufficiently wide for personnel and vehicles to pass therealong.

It should be noted that detonation of the cloud may result in detonation of the mines, either by causing sympathetic detonation of the explosives therein or by causing depression of the mine's pressure plate to thereby actuating the mine. It is perhaps more likely, however, that detonation of the cloud will neutralize the mine, rendering it ineffective, as for example by mechanically destroying the mine's fuzing system.

The inclusion of the detonating cord 24 within the hose 16 as described hereinbefore will generally work quite satisfactorily since the hydrocarbon fuel within the hose will tend to "float" the cord, keeping it out of contact with the hose inner wall 27. However, such contact can occur and at the time of detonation there could be a jet of hot combustion products and debris emerging from the hose wall at each point where the cord 24 is in contact with the hose wall. Usually the hot material will be quenched by the surrounding or neighboring fuel and the proper formation of a fuel droplet-air cloud ensues. If a piece of debris remains at a high enough temperature until the fuel/air ratio within the cloud reaches a value that will support combustion, there could be premature deflagration of the fuel droplet-air cloud. When this occurs the bulk of the fuel droplet-air cloud can be consumed by the flame before the secondary high-explosive charges get a chance to function. Consequently, the resultant detonation/combustion process generates very low pressures and mines in the area of the hose may not be detonated or neutralized.

The problem of hot spots can be avoided by keeping the detonating cord out of contact with the hose inner wall 27 and FIGS. 5A to 5D illustrate four ways of accomplishing this.

Figure 5A:
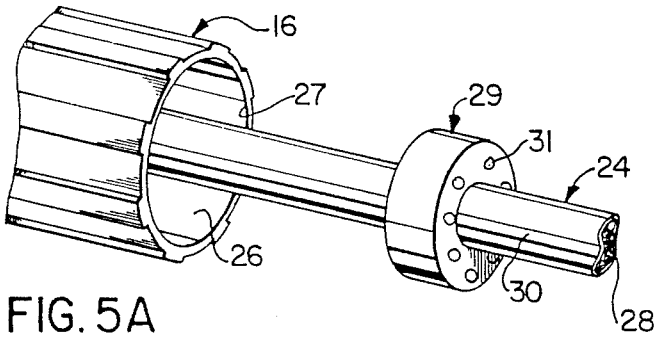
FIGS. 5A to 5D illustrate schematically several means for spacing the detonating cord from the inner wall of the hose.

In FIG. 5A a plurality of plastic discs 29 can be placed on the cord 24 along its length, each disc having a diameter less than that of the hose interior. Axially extending through bores 31 can be provided to help avoid inhibiting the flow of fuel along the hose.

Figure 5B:
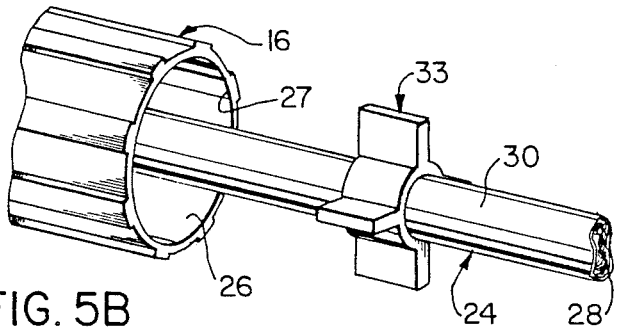

In FIG. 5B a cruciform spacer 33 are shown on the cord 24. A plurality of these spacers could be used and it would not be necessary to have them made from a rigid material or fully in contact with the hose inner wall. This spacer, and the spacer 29 of FIG. 5A, has the disadvantages that it can create large flow losses during the fuel filling operation and it can make hose storage awkward, cumbersome and bulky.

Figure 5C:
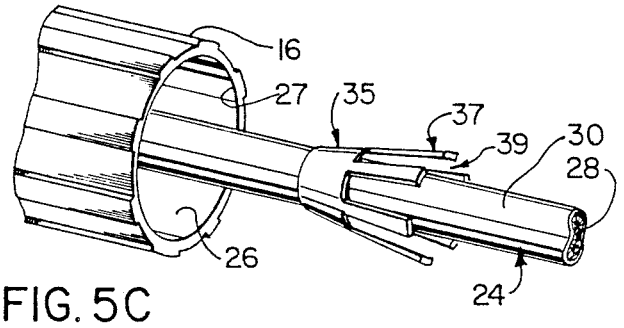

FIG. 5C shows a spacer 35 which has a plurality of flexible spring-like fingers 37 which would collapse during packaging or storage of the hose, due to the weight of hose sections thereabove, but which would move the cord 24 into a central position within the hose as the hose is deployed. There are gaps 39 between the fingers to permit fuel to pass thereby during filling and preferably the fingers face downstream to further reduce flow losses.

Figure 5D:
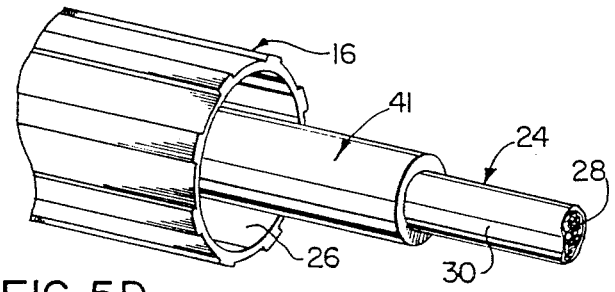

FIG. 5D shows a preferred form of spacing means, namely a jacket 41 which extends the length of the cord 24. The jacket 41 should be made of neoprene or another foam rubber material capable of resisting attack by the hydrocarbon fuel being used. The material should also be of an open cell construction to allow fuel to completely surround the cord 24. A low density foam is preferred so as to displace as little fuel as possible and to provide little flow resistance during filling. By using a material that is compact when dry means that there will be fewer packaging problems in comparison to the embodiments of FIGS. 5A to 5C, and if the material will swell when exposed to liquid fuel the cord 24 will be moved towards to the centre of the hose for optimum dispersion of the fuel upon detonation of the cord.

The specific advantages to the system of the present invention are as follows:

(i) The present system breaches a continuous lane using fuel-air explosives. Thus, it combines the attractive features of the GIANT VIPER and the SLUFAE into a single apparatus.

(ii) Although the concept of dispersing liquid fuel to form a droplet-air cloud, and subsequently detonating it, is not new, the present line-charge configuration is thought to be novel in that is enables the formation of long hemicylindrical clouds. Existing FAE devices produce circular pancake shaped clouds.

(iii) The present system, unlike either the GIANT VIPER or SLUFAE systems, delivers the empty fuel container (i.e., hose) to the breach site. Subsequently, in a post-filling operation, fuel is supplied to the container. The smaller rocket-delivered payload means reduced complexity and lower cost. There is also less likelihood that the empty line-charge hose (weighing about 0.5 kg/m) will trigger an anti-personnel mine when it lands than will the GIANT VIPER (weighing 6.3 kg/m).

(iv) The concept of post-filling means that a variety of liquid fuels can be used with the system (e.g., propylene oxide, hexylnitrate, ethylhexylnitrate, sensitized vehicle fuels, etc.). This feature may be a valuable asset in a wartime situation where the availability in specific materials at the battle front may be limited.

(v) The concept of post-filling means that the characteristics of the FAE line charge can be altered shortly before deployment. For example, the addition of aluminum particles or high-explosive particulates to the liquid fuel will enhance the pressure-impulse performance of the cloud, thus increasing the possibility that hardened or long-duration mines will be defeated. Another example is the addition of n-propylnitrate to the fuel in order to sensitize it for use in low-temperature environments.

(vi) The concept of post-filling means that the application of the line charge can be determined shortly before deployment. For instance, the use of high-explosive slurry or nitromethane fuel would result in a line charge substantially identical to the GIANT VIPER. That is, the use of these fuels permits the charge to become a high-explosive one rather than one of lower energy density fuel-air. This bimodal HE/FAE feature is thought to be novel.

(vii) The present line-charge system is safer than the GIANT VIPER in that the fuel is non-explosive until it is mixed with air during the fuel dispersal phase. The PE6/A1 material in the GIANT VIPER is detonable while in the trailer and thus poses a greater threat to personnel in the carrier vehicle.

(viii) The cost of expendable materials is an order of magnitude less than for either the GIANT VIPER or SLUFAE systems (for similar performance). The estimated cost for a 200 m long breach with the present system is about ⅛ of the cost per breach (183 m long) for the GIANT VIPER. The cost of each rocket-propelled SLUFAE canister, complete with rocket, parachute and initiation system is about $5K (U.S.) for a total breach (30 canisters) cost in excess of that for the GIANT VIPER. The lower cost of the present system is the result of technical simplicity, a smaller rocket-propelled payload and the use of readily available materials (e.g., fire hose and detonating cord are off-the-shelf items; most fuels are commonly available in the automotive or plastics manufacturing industry).

(ix) The present system is not restricted to use with a rocket type of hose deployment means as is shown herein. The system could utilize a self-propelled, remotely operated vehicle having large-footprint, low pressure tires to either tow the hose from the carrier means across the minefield or to lay the hose therefrom as it traverses the minefield. Such a vehicle exerts very low pressures on the ground and can travel on a minefield with a low likelihood of detonating a pressure sensitive mine.

The description as provided herein is intended to set forth the preferred form of the present invention as currently envisaged. It is expected that skilled persons in the art could alter details of the invention without departing from the spirit thereof. Accordingly, the protection to be afforded the present invention is to be determined from the claims appended hereto.

The embodiments of the invention in which an exclusive property or privilege is claimed are defined as follows:

1. A system for breaching a safe lane through a minefield containing pressure sensitive mines comprising:
(a) mobile carrier means;
(b) a length of flexible hose carrying therein and therealong a small diameter cord of explosive material, said hose being carried by said carrier means for deployment therefrom;
(c) hose deployment means carried by said carrier means and launchable therefrom, one end of said hose being connected to said deployment means with the other end of said hose being connected to said carrier means;
(d) liquid fuel storage means on said carrier means; and
(e) means on said carrier means for rapidly transferring fuel from said storage means to said hose after deployment thereof; such that
(f) when said cord is detonated after hose deployment a cloud of fuel droplets-in-air is created above said minefield along a line defined by the deployed hose; and
(g) thereafter detonating said cloud creates a pressure wave which detonates or neutralizes the mines along said lane.

2. The system of claim 1 wherein said carrier means comprises a trailer towable behind a vehicle such as a tank or an armoured personnel carrier.

3. The system of claim 1 wherein said fuel comprises a high-explosive slurry or nitromethane.

4. The system of claim 1 wherein said hose is a commercially available fire hose.

5. The system of claim 1 wherein said fuel may be selected from the group comprising liquid propylene oxide, hexylnitrate and ethylhexylnitrate.

6. The system of claim 5 including particles of aluminum or high-explosive within the fuel.

7. The system of claim 1 wherein said hose includes a plurality of small secondary charges spaced apart along said hose for detonating said cloud following detonation of said cord.

8. The system of claim 7 wherein each secondary charge is connected to a spring wire which in turn is connected to said hose by a flexible expandable sleeve, said charge being initially held against said hose by a rupturable band, the rupture of which permits said spring wire to move its secondary charge to a position spaced from said hose.

9. The system of claim 1 including means for spacing said cord from an inner wall of said hose along the length thereof.

10. The system of claim 9 wherein said spacing means includes a plurality of spaced apart disc members surrounding said cord, each being of a diameter intermediate between the outer diameter of said cord and the inner diameter of said hose and having a plurality of flow permitting holes extending axially therethrough.

11. The system of claim 9 wherein said spacing means includes a plurality of spaced apart cruciform members secured to said cord.

12. The system of claim 9 wherein said spacing means includes a plurality of spacer members spaced apart along said cord, each said spacer member having a plurality of flexible finger members extending outwardly downstream therefrom.

13. The system of claim 9 wherein said spacing means includes a jacket of foam material surrounding said cord along the length thereof, said jacket having a diameter intermediate the outer diameter of said cord and the inner diameter of said hose.

14. The system of claim 13 wherein said foam material is of an open cell configuration, can resist attack by said fuel, and will swell in the presence of said fuel.

15. The system of claim 1 wherein said hose includes a main hose section and an umbilical hose section of a diameter smaller than that of said main hose section, said cord of explosive material extending primarily within said main hose section and being connected through said umbilical hose section to said carrier means.

16. The system of claim 15 wherein drogue parachutes are attached to said hose sections to retard said hose sections during deployment thereof.

17. The system of claim 15 wherein said deployment means comprises a rocket-propelled tow vehicle connectable via a bridle/cable/swivel assembly to the adjacent end of said main hose section.

18. The system of claim 17 wherein drogue parachutes are attached to said hose sections to retard said hose sections during deployment thereof.

19. The system of claim 17 wherein said storage means comprises a tank mounted on said carrier means said tank being connectable to said umbilical hose section, and said fuel transferring means comprises at least one tank of pressurized nitrogen mounted on said carrier means and connectable to said fuel storage tank such that pressurized nitrogen gas will enter said fuel storage tank to drive fuel therefrom, through said first valve means, and into said umbilical and main hose sections.

20. The system of claim 17 wherein said carrier means includes a launch rail along which said tow vehicle is guided during launch, said umbilical hose section being connected to one end of said launch rail.

21. The system of claim 20 wherein the other end of said launch rail is pivotably connected to said carrier means, there being hydraulic shock absorber means extending between said launch rail and said carrier means, whereby said rail is pivotable against forces imposed by said shock absorber means to absorb tension forces in said hose sections.

22. A system for breaching a safe lane through a minefield containing pressure sensitive mines comprising:
(a) mobile carrier means mounting thereon a hose storage magazine, a liquid fuel storage tank, a water storage tank, pressurized nitrogen storage tanks connectable to said fuel and water tanks, and a launch rail;
(b) a length of flexible umbilical hose in said magazine folded for rapid deployment from said magazine, one end of said umbilical hose being secured to one end of said launch rail and connectable for communication with either of said fuel or water storage tanks;
(c) a length of flexible main hose, of larger diameter than said umbilical hose, stored in said magazine and folded for rapid deployment therefrom, one end of said main hose being connected to the other end of said umbilical hose, the other end of said main hose carrying valve means and a swivel assembly;

(d) a small diameter cord of explosive material extending at least the length of said main hose and connected to said carrier means via said umbilical hose, said main hose including a plurality of secondary charges spaced apart therealong;

(e) at least two drogue parachutes carried by said hoses for deployment at a predetermined time of flight of said hoses; and (f) a rocket propelled tow vehicle carried by said carrier means for launching therefrom along said launch rail, said tow vehicle being connected to said swivel assembly at the other end of said main hose by a bridle/cable assembly;

whereby, in order to breach the minefield: said tow vehicle is launched from said carrier means to traverse said minefield while pulling said hoses from said magazine, said hoses trailing said vehicle; as said vehicle comes to earth said parachutes are deployed to bring said hoses safely to earth along a line extending from said carrier means to said vehicle; after said hoses are on the minefield said nitrogen tanks are opened to drive liquid fuel from the fuel storage tank to fill the hoses with fuel; thereafter the pressurized nitrogen is directed to said water tank to drive water into said umbilical hose, forcing excess fuel through said valve means until said umbilical hose is substantially filled with water; thereafter said hose is detonated to burst said main hose and to create a cloud of fuel droplets-in-air above and along said line; and thereafter said secondary charges are detonated to detonate said cloud to create a pressure wave which, in turn, detonates or neutralizes the mines along said lane.

23. The system of claim 22 wherein the other end of said launch rail is pivotally connected to said carrier means, there being hydraulic shock absorber means extending between said launch rail and said carrier means, whereby said rail is pivotable against forces imposed by said shock absorber means to absorb tension forces in said hoses as said hoses fall to earth.

24. The system of claim 22 wherein each secondary charge is connected to a spring wire which in turn is connected to said main hose by a flexible expandable sleeve, said charge being initially held against said main hose by a rupturable band, the rupture of which permits said spring to move its secondary charge to a position spaced from said main hose.

25. A system for breaching a safe lane through a minefield containing pressure sensitive mines comprising:

(a) a mobile carrier means;

(b) a length of flexible hose carrying therein therealong a small diameter cord of explosive material, said hose being carried by said carrier means for deployment therefrom;

(c) hose deployment means for deploying said hose across the minefield, one end of said hose being connected to said deployment means with the other end being connected to said carrier means;

(d) liquid fuel storage means on said carrier means; and (e) means on aid carrier means for rapidly transferring fuel from said storage means to said hose after deployment thereof; such that (f) when said cord is detonated after hose deployment and filling a cloud of fuel droplets-in-air is created above said minefield along a line defined by the deployed hose; and (g) thereafter detonating said cloud creates a pressure wave which detonates or neutralizes the mines along said lane.

26. The system of claim 25 wherein said hose includes a plurality of small secondary charges spaced apart along said hose for detonating said cloud following detonation of said cord.

27. The system of claim 26 wherein each secondary charge is connected to a spring wire which in turn is connected to said hose by a flexible expandable sleeve, said charge being initially held against said hose by a rupturable band, the rupture of which permits said spring wire to move its secondary charge to a position spaced from said hose.

28. A method of breaching a safe lane through a minefield containing pressure sensitive mines comprising the steps of:

(a) deploying a length of flexible hose across the minefield, said hose carrying a small diameter cord of explosive material therein and therealong;

(b) filling a substantial portion of said hose laying on the minefield with a liquid fuel;

(c) detonating said cord to create a cloud of fuel droplets-in-air above said minefield along a line defined by said hose portion; and (d) thereafter detonating said cloud to create a pressure wave which detonates or neutralizes the mines along said lane.

29. The method of claim 28 wherein fuel is introduced into said hose portion to create a volume ratio of fuel to cord of about 50:1.

* * * * *